United States Patent [19]

Berndt et al.

[11] 3,951,376

[45] Apr. 20, 1976

[54] MOLD WITH TENSIONED CABLE ADJUSTING MEANS

[75] Inventors: Otto Berndt, Memmingen; Edmund Dolfen, Moers; Gerhard Strese, Kamp-Lintfort, all of Germany

[73] Assignee: Grunzweig & Hartmann und Glasfaser AG, Ludwigshafen, Germany

[22] Filed: Sept. 27, 1974

[21] Appl. No.: 509,898

[30] Foreign Application Priority Data

Sept. 27, 1973 Germany ..... 2348655

[52] U.S. Cl. ..... 249/146; 249/152; 249/155; 249/162

[51] Int. Cl.[2] ..... B28B 7/02

[58] Field of Search ..... 249/27, 49, 63, 144, 249/152, 155, 157, 158, 162, 178, 180, 184; 425/441

[56] References Cited

UNITED STATES PATENTS

| | | | |
|---|---|---|---|
| 1,183,169 | 5/1916 | Crist | 249/157 |
| 1,379,965 | 5/1921 | Cleland et al. | 249/162 |
| 1,670,339 | 5/1928 | Butterworth | 249/49 |
| 2,443,059 | 6/1948 | Veward | 249/49 |
| 2,691,996 | 10/1954 | McNair | 249/194 |
| 3,677,512 | 7/1972 | Thomas | 425/441 |

*Primary Examiner*—Francis S. Husar
*Assistant Examiner*—John McQuade
*Attorney, Agent, or Firm*—Webb, Burden, Robinson & Webb

[57] ABSTRACT

A forming device for prefabricating structures having a size-adjustable core surrounded by a shell structure displaceable with respect to the core. The shell structure is constructed of a plurality of frame members each independently adjustable with respect to the core. One or more tensioning cables surround the core, the cables being reeved through a series of fixed and movable pulleys mounted at each corner of the shell formed by the intersecting frame members. By operating the cables the frame members are adjustable with respect to the position of the core of the forming device.

9 Claims, 12 Drawing Figures

MOLD WITH TENSIONED CABLE ADJUSTING MEANS

BACKGROUND OF THE INVENTION

The invention relates to a forming device for the production of structures of large volume, such as space frames or cells, containers, vehicle superstructures and the like, comprising a core and an external shell surrounding the core at a distance from the latter.

An increasing demand is noticeable, in the building industry in particular, for devices whereby it is possible to produce structures, e.g. bathrooms, in one piece and in large numbers. Casting moulds constructed in accordance with each particular application have had to be relied on until the present. Coping with the shutting and opening forces of the known devices, during production which may be very great due to the substantial dimensions of the structures to be produced, combined with long operating paths for the moulds, has proved to be a difficult procedure. Attempts to overcome this disadvantage by means of hydraulic or pneumatic actuating devices were unsuccessful, first since very complex hydraulic assemblies are required, and second since the forces generated by the assemblies can be distributed evenly over the separate mould surfaces only by employing expensive apparatus. For these reasons, the casting moulds of known design are little mechanised, or alternatively, the present prefabrication of structures of large volume is substantially restricted to the application of such castable materials as have relatively low shutting and opening forces.

By contrast, the present invention provides a largely mechanised forming device of the kind defined in the foregoing, which despite having an uncomplicated and inexpensive form of construction, offers very extensive scope regarding the shape imparted to the various structures which are to be produced or in respect of the materials to be used, and wherein it is possible to readily cope with any particular shutting and opening forces.

SUMMARY OF THE INVENTION

In accordance with the present invention therefore, the core of the forming device is so constructed that its size may be reduced, and the outer shell is formed by a plurality of form frames which are movable separately towards the core and away from the latter, the form frames being externally and conjointly surrounded by at least one tensioning cable of variable length and extending in one or more planes, and lining members constructed to correspond to the configuration of the lining members being arranged so that they may be installed on the form frames.

The tensioning cable is concomitantly and preferably reeved through a set of movable rollers and a set of fixed rollers at each point of intersection between adjacent form frames.

In another aspect of the invention, at each point of intersection of two adjacent form frames a bearer is located, intended for the set of movable rollers and arranged to be displaceable in both their longitudinal directions. The rollers comprise at least one inner roller and two double rollers which are independently rotatable and positioned with spacing between them. At each terminal portion of a form frame at least one fixed roller is installed, which form the set of fixed rollers belonging to the set of movable rollers. The inner rollers of the bearers situated in one plane are in the direction of a displacement of the form frames towards the core measured from the portion of the tensioning cable, whereas the double rollers and the fixed rollers guide another portion of the tensioning cable around the form frames, in such a manner that a force exerted on this portion moves the form frames away from the core. It will be appreciated that two separate tensioning cables may be incorporated moreover for the displacement of the form frames, instead of only one tensioning cable.

In accordance with the invention, the core is formed by a plurality of movable core frames as bearers for the lining members. Mutually opposed core frames are concomitantly interconnected by a mechanism adapted to reduce their mutual spacing, so that the core may be reduced in size for easier removal of the finished structure.

This is appropriately combined with an arrangement that at least one of the lining members which may be installed on each core frame is equipped with a mechanism for varying its width and that each gap between the edges of two adjacent core frames is overbridged by a rigid marginal lining member borne by both core frames.

In accordance with the invention, several independently displaceable form frames for optionally shaped and exchangeable lining members, which establish an outer forming shell around the core, said shell being closed and variable within wide limits, are thus incorporated as bearers for the lining members. In accordance with the invention, the core itself is assembled from a plurality of core frames arranged to be displaceable with respect to each other, and whereon it is possible to instal lining members shaped to match the internal shape of the element which is to be produced, in exchangeable manner. Elements having a variety of shapes, e.g. optionally having angular round or combined cross-sections, may be produced in this manner by means of one and the same device and without extensive resetting operations.

It is an essential feature of the invention moreover, that the form frames are surrounded by a tensioning cable in one or more horizontal planes, which moves the form frames towards or away from the core and by means of which the shutting and opening forces are applied. The shutting forces acting on the form frames increase in proportion to the number of planes of enloopment of the cable around the form frames. A relatively small power therefore is required to apply forces of any predetermined magnitude. As compared to hydraulic assemblies these forces are controlled in a particularly uncomplicated manner. Since the forces do not moreover act centrally on the form frames but are spread over different points, a relative skewing action between the form frames is prevented despite the large surfaces, and an optimum shutting and opening action is assured. The form frames may be moved in the direction towards or away from the core, either jointly or separately. This may be accomplished by obstructing the displacement of one or more form frames, e.g. by means of a brake or locking device. This offers the possibility so to affect the strains acting on the element, in particular upon stripping the element from the form, that damage is prevented.

Finally, in accordance with the invention structures may be produced from any suitable castable materials, e.g. concrete, expansible plastics materials with or without reinforcing materials, polyester concrete and the like. The pressing of loose materials which are mixed with a hardenable binder, is also possible with the forming device in accordance with the invention.

BRIEF DESCRIPTION OF THE DRAWINGS

The invention will be better understood from the following description of preferred embodiments thereof taken with reference to the drawings, wherein.

DETAILED DESCRIPTION OF PREFERRED EMBODIMENTS

Figure 1:
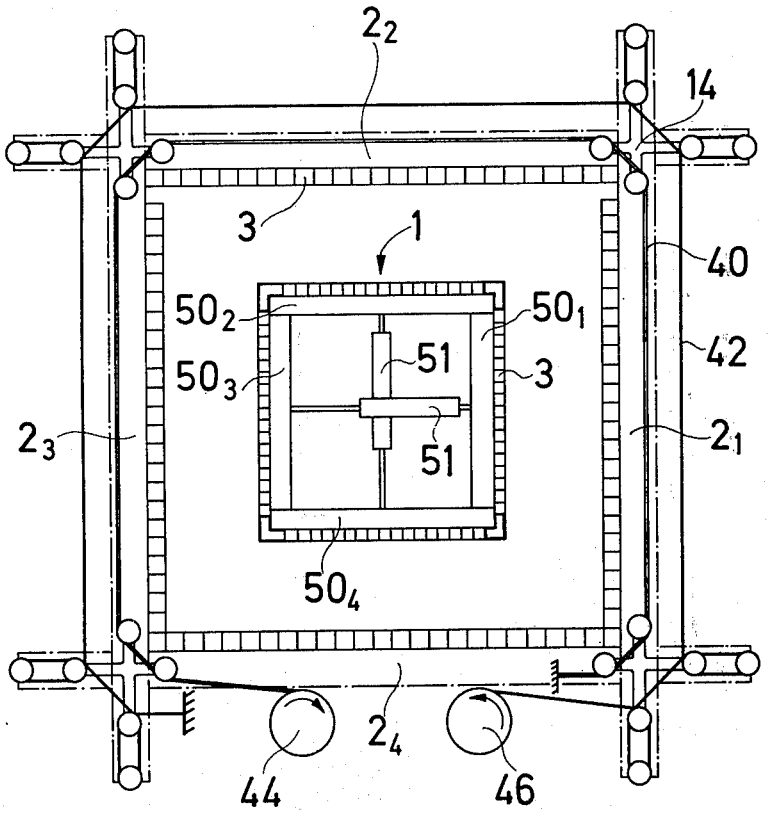
FIG. 1 shows a schematic plan view of the forming device.

With reference to FIG. 1, the forming device comprises a core generally designated as 1, and a plurality of form frames which in the present embodiment amount to four and designated $2_1$ to $2_4$. The latter are so arranged with respect to each other that they surround the core in the manner of an outer forming or moulding shell. On the external sides of the core 1 and on the inner sides of the form frames facing the core, are removably suspended lining members 3 which have a shape corresponding to the external and internal configurations of the structure which is to be produced, and which may for example also be equipped with projections whereby window openings or the like are produced in the structure.

Figure 2:
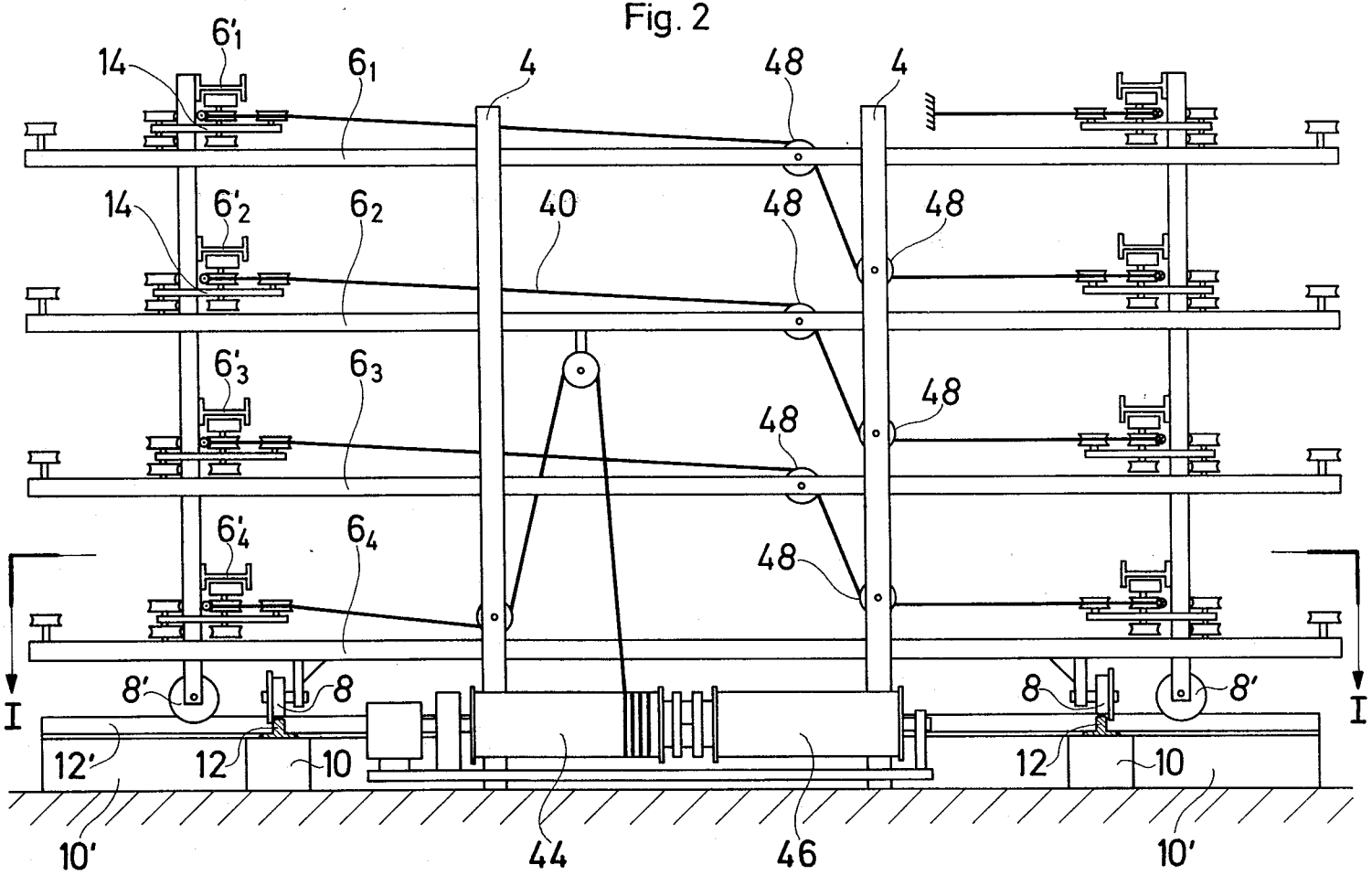
FIG. 2 shows a schematic elevational view of the forming device of FIG. 1.
Figure 3:
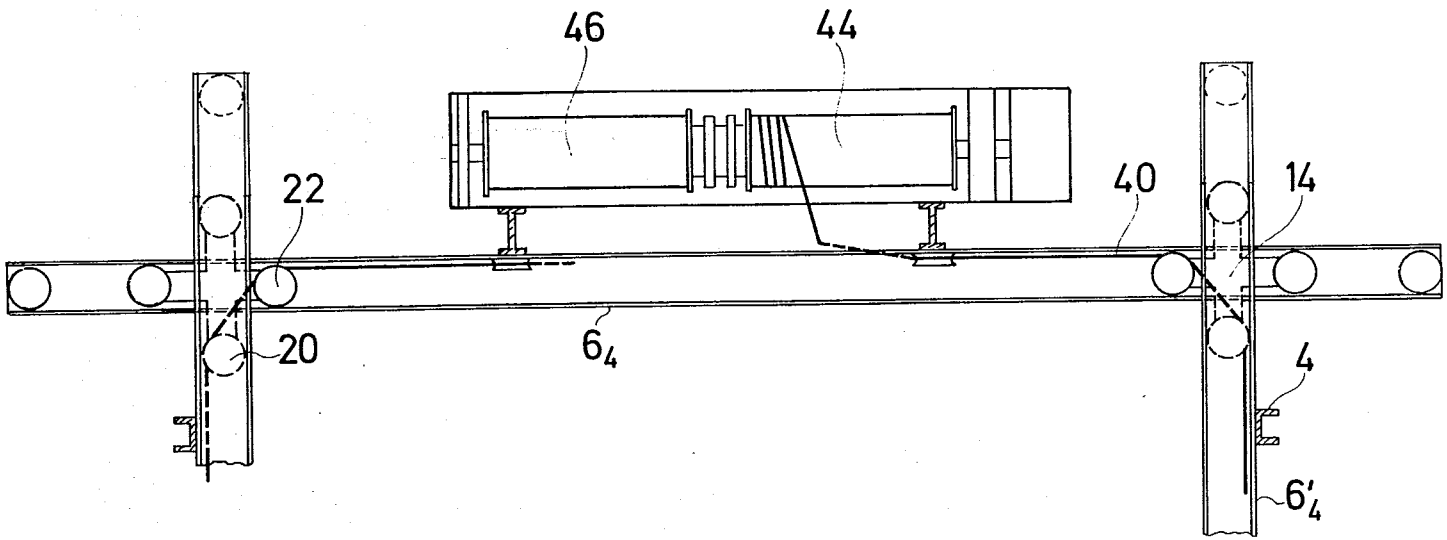
FIG. 3 shows a cross-section along the lines I—I of FIG. 2.

With reference to FIG. 2, each form frame $2_1$ to $2_4$ may be assembled from a plurality of horizontal beams $6_1$ to $6_4$ positioned parallel to and with mutual spacing from each other, and two or more vertical pillars 4 interconnecting the beams, consisting of U or T sections. It will be understood however that any other appropriate arrangement may also be employed instead of the structure depicted in FIG. 2. Each form frame $2_1$ to $2_4$ moreover comprises track wheels 8, 8′ which are secured with a spacing between them on beam $6_4$ and a rearwardly extending beam $6_4'$, the track wheels rolling longitudinally in the manner depicted on rails 12, 12′ respectively fastened on supporting pedestals 10, 10′. To prevent tipping of the form frames, other appropriate guiding roller systems, which are not illustrated, and which co-operate with stationary guiding tracks also not shown, may be installed e.g. at the upper extremities of the pillars 4. The rails 12, 12′ for each form frame are laid in such a manner with respect to the core 1, that each form frame may be displaced towards or away from the core, and the distance between the form frame and the corresponding external surface of the core may be varied within wide limits.

Moreover, as shown in FIG. 2, beams $6_1'$ to $6_4'$ of the rearwardly extending form frames $2_1$ and $2_3$ (FIG. 1) are arranged in staggered position with respect to the beams $6_1$ to $6_4$ of the front and rear form frames $2_2$ and $2_4$, so that the terminal portions of the beams of adjacent form frames may be inserted between each other without mutual obstruction. Depending on the position of the form frames $2_1$ to $2_4$ with respect to the core 1, the terminal portions of the beams $6_1$ to $6_4$ or $6_1'$ to $6_4'$ project outwards to a greater or lesser extent.

Figure 4:
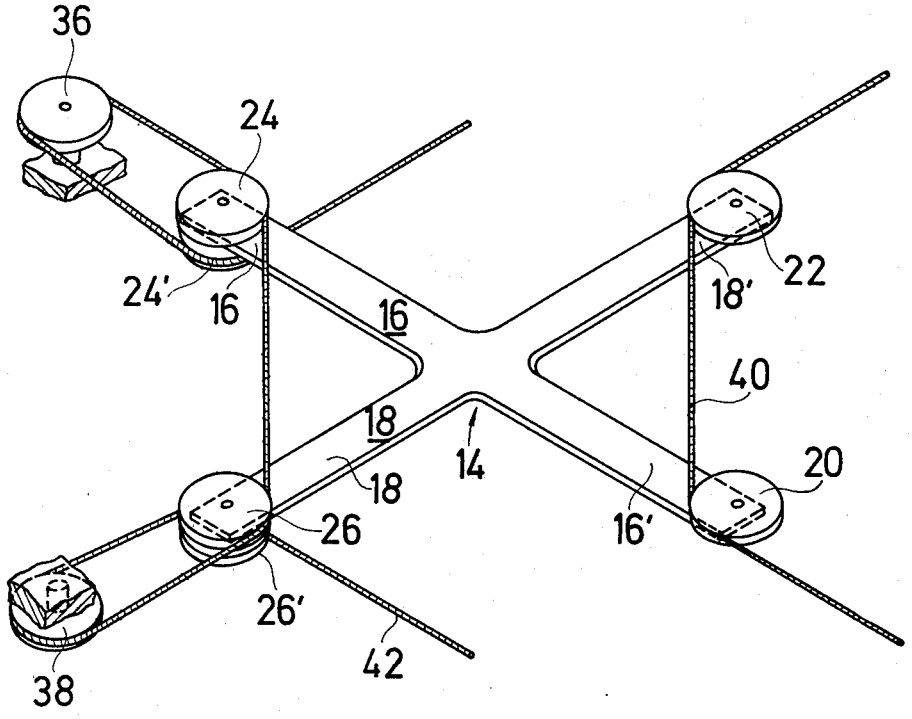
FIGS. 4 and 5 show a perspective view and an orthogonal view of a bearer for the set of movable cable guiding pulleys, which is situated at a junction point of two adjacent form frames.
Figure 5:
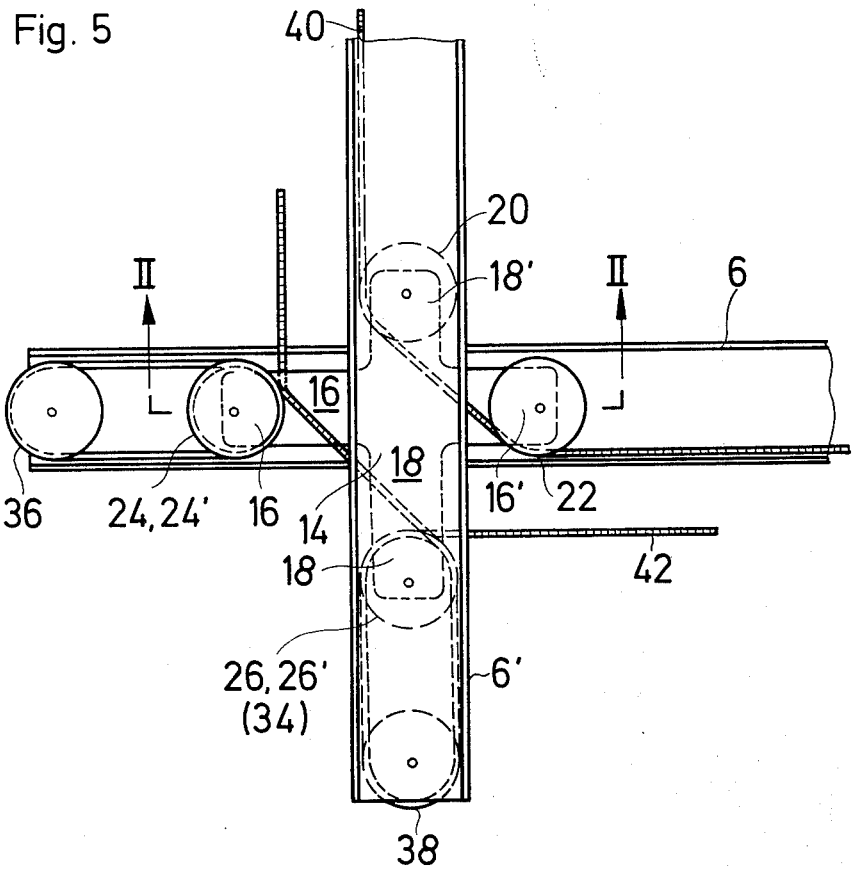

A bearer 14 for a set of movable pulleys 20, 22, 24, 24′, 26 and 26′ which is shown in FIGS. 4 and 5 and which is guided at the same time in the longitudinal directions of both beams, is installed at the junction point of two beams extending in different directions, e.g. at the junction point of the beams $6_1$ and $6_1'$ according to FIG. 2. As shown in FIGS. 4 and 5, the bearer 14 may be cruciform, its branches 16 and 18 concomitantly extending in the corresponding longitudinal directions of the beams $6_1$, $6_1'$. The inner extremities 16′ and 18′ of the branches 16 and 18 each rotatably carry a single pulley 20 and 22, whereas the corresponding oppositely situated outer extremities 16, 18 are each equipped with a rotatable double pulley 24, 24′ and 26, 26′. The pulleys of each double pulley are concomitantly rotatable independently of each other. Moreover, a guiding roller 28, 30, 32, 34 is incorporated co-axially with each pulley 20 and 22 and each double pulley 24, 24′ and 26, 26′. The guiding rollers 32, 34 co-ordinated with the branch 18 of the bearer 14 extend from below between the U-branches of the beam $6_1$ and the guiding rollers 28, 30 co-ordinated with the branch 16 between the U-branches of the beam $6_1'$ (see FIG. 6). The guiding rollers 28 to 34 have conical track surfaces corresponding to the inclination of the inner surfaces of the U-branches.

Finally, a fixed pulley 36 and 38 is rotatably arranged on each outer terminal portion of a beam, e.g. $6_1$ and $6_1'$. The two fixed pulleys 36, 38 co-operate with the double pulleys 24, 24′ and 26, 26′ on the bearer 14, in the following manner.

In accordance with FIG. 1, an external tensioning cable 42 and an internal tensioning cable 40 which are guided externally around the form frames by means of the pulleys on the bearers 14 situated at each junction point, serve the purpose of moving the form frames $2_1$ to $2_4$ in the direction towards and away from the core 1. One extremity of each tensioning cable 40, 42 is anchored to an appropriate point of the forming device, whereas the other extremities of the tensioning cables are wound on separate drums 44, 46 which are driven by a motor. In accordance with FIGS. 1 and 5, the inner tensioning cable 40 runs externally around the inner pulleys 20, 22 of the bearers 14, so that when the tensioning cable 40 is wound on to the corresponding drum 44, an inwardly directed force is exerted at the same time on the beams $6_1$ and $6_1'$ via the pulleys 20, 22 and the corresponding guiding rollers 28, 32, and that the form frames $2_1$ to $2_4$ guided by means of the rails 14 are thereby moved together towards the core. It is understood that the other drum 46 for the outer tensioning cable 42 concomitantly runs loose, so that the outer tensioning cable 42 may unwind freely from the drum 46.

Conversely, the outer tensioning cable 42 extends around the outer double pulleys 24, 24' and 26, 26' of the bearers 14 and around the fixed pulleys 36, 38 situated at the end sides of the beams, e.g. $6_1$ and $6_1'$. As apparent from FIG. 4 in particular, the incoming tensioning cable 40 is initially run along the lower pulley 24' of the one double pulley 24, 24', then around a fixed pulley 36 and back from the same and around the pulley 24. From the pulley 24, it runs on to the upper pulley 26 of the other double pulley 26, 26' and, after deflection around the other fixed pulley 38, back to the lower pulley 26' from which it then runs to the next junction point. In essence, the tensioning cables 40, 42 concomitantly extend parallel to and with a small mutual spacing from the form frames $2_1$ to $2_4$, so that excessive bending moments on the beams $6_1$ to $6_4$ and $6_1'$ to $6_4'$ are prevented. Consequently, if the outer tensioning cable 42 is wound on to the corresponding drum 46, the drum 44 for the inner tensioning cable 42 concomitantly being declutched from the drive, a force which opens the forming device and displaces the form frames away from the core 1 is exerted on the form frames via the double pulleys 24, 24' and 26, 26' of the bearers 14 and the corresponding guiding rollers 32, 34.

The two tensioning cables 40, 42 are appropriately laid externally around the form frames in analogous manner to that described in the foregoing, in several horizontal planes situated one above another, as illustrated with respect to the run of the inner tensioning cable 40 in FIG. 2. For this purpose, the bearer 14 carrying the appropriate pulleys may for example be situated at each junction point situated at different heights between adjacent beams, and a fixed pulley 36, 38 may for example be situated in each case at the extremities of the beams. It is understood that upon passing from one plane to another, the tensioning cables are guided to the next plane in the manner shown in FIG. 2 by means of deflecting pulleys 48 positioned at appropriate points on a form frame. For reasons of ease of illustration, it is only the run of the inner tensioning cable 40 along several planes which has been shown in FIG. 2; the outer tensioning cable 42 is guided in a corresponding manner.

By means of the enlooping of the form frames in several planes, the forces exerted on the form frames and directed inward towards or away from the core, increase in accordance with the number of planes of enloopment, without having to apply a greater tractive force on the tensioning cables 40, 42. The forces do not moreover act in one plane, but concomitantly in several planes on the form frames, so that a substantially uniform areal stress is established.

It is apparent from the foregoing that when a force is applied on the inner or outer tensioning cables 40 and 42, the form frames $2_1$ to $2_4$ are displaced conjointly in the corresponding directions. If required however, one or more form frames may also have their displacement impeded by appropriate immobilising devices which are not illustrated, so that the other form frames only are displaced in corresponding manner.

Finally, it is important to point out that a single tensioning cable only may also be incorporated instead of two separate tensioning cables, by securing its two extremities on two rigidly interconnected drums in such a manner that when the two drums are driven in one and the same direction, an unwinding action occurs on the one drum and a winding action occurs on the other.

Figure 7:
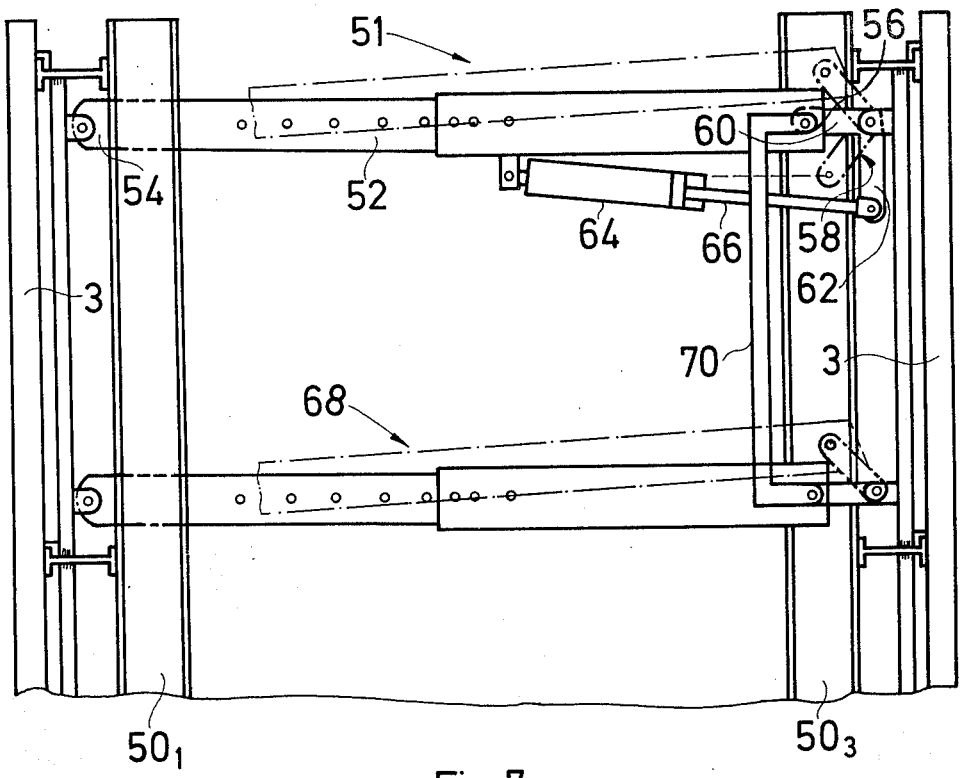
FIG. 7 shows a lateral elevation of a mechanism for varying the distance between two oppositely situated core frames.
Figure 8:
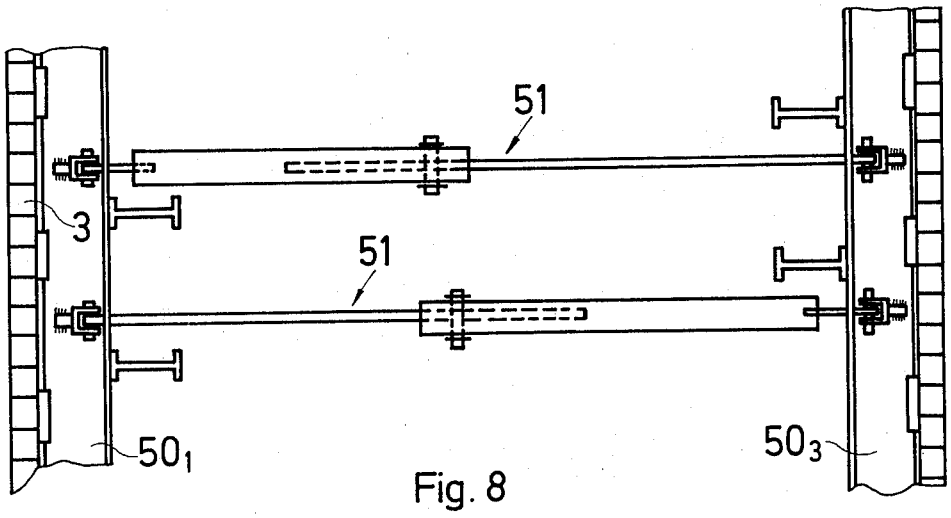
FIG. 8 shows a plan view of the mechanism of FIG. 7.
Figure 9:
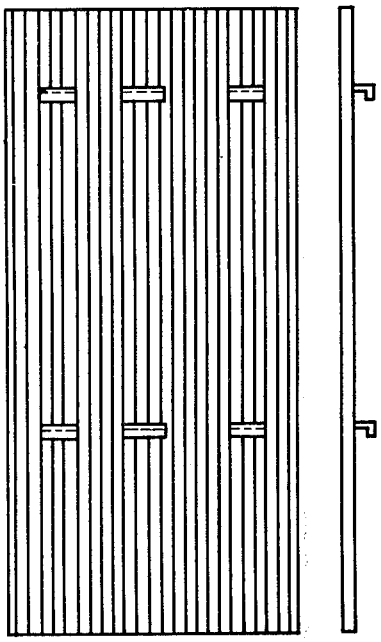
FIG. 9 shows a lining member of a real construction in frontal and lateral elevation, which is usable for suspending the same on the form and core frames.
Figure 10:
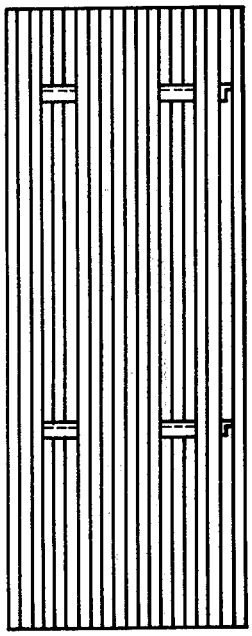
FIGS. 10 and 11 show a frontal elevation and a plan view of a marginal lining member for the core frames.
Figure 11:
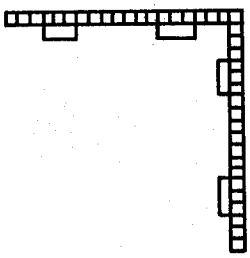

In order that the structure formed by means of the device as shown in FIG. 1 may be stripped from the form or mould, the core is assembled in accordance with the invention from a plurality which amounts to four in the present case, of core frames $50_1$ to $50_4$ which are displaceable with respect to each other, and from which it is possible to suspend lining members 3 as shown in FIGS. 9 to 11. A correlated mechanism which may be actuated hydraulically, pneumatically or mechanically, serves the purpose of varying the distance between oppositely situated core frames. This mechanism may, for example, comprise a toggle lever system 51 illustrated in FIGS. 7 and 8, which comprises a longitudinally adjustable rod 52. The rod 52 is pivotally coupled at one end 54 to one of the two oppositely situated core frames and is pivotably connected at the other end 56 to the one arm 60 of an angle lever 58. The lever 58 is pivotally coupled to the other core frame. The other arm 62 of the lever 58 has a piston rod 66 of an actuating cylinder 64 connected to at which cylinder is pivotably arranged at a predetermined point on the rod 52. The angle lever 58 is turned when the piston rod 66 is extended, the rod 52 thereby being displaced upwards into the position shown by dash-dotted lines in FIG. 7. In this position, the two oppositely situated core frames are brought closer to each other by a definite distance adequate for the stripping of the formed structure from the form. Another toggle lever mechanism 68 which may either be acted upon separately by means of an appropriate actuating member or which is coupled via a connecting rod 70 to the first toggle lever mechanism 51 in such manner that the two toggle lever mechanism 51, 68 are displaced in like manner, is positioned parallel to and spaced from the toggle lever system 51.

It is understood however that any other appropriate mechanism may be incorporated for the purpose of varying the distance between oppositely situated core frames instead of the mechanism described in the foregoing, and that the other oppositely situated core frames are interconnected by means of mechanisms of this nature.

Figure 12:
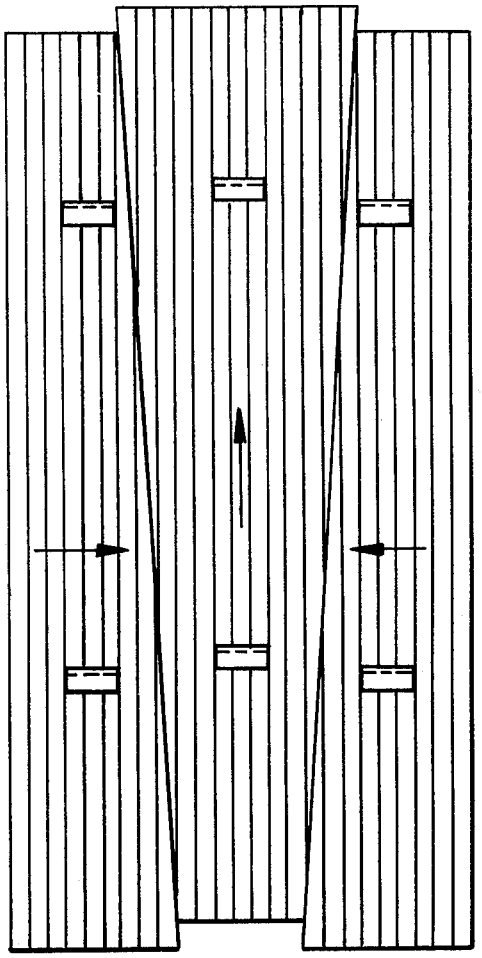
FIG. 12 illustrates elements and other lining elements comprising draw wedges as more fully explained herein.

The mechanisms for varying the spacing between the core frames operate in combination with lining elements which are not illustrated and comprise mechanisms for reducing their width. At least one lining element of this kind is installed on each core frame, the mechanism for reducing its width being a draw wedge for example, which is shown in FIG. 12. The draw wedges are withdrawn from the lining elements in question prior to actuation of the toggle lever systems, so that the lining elements may be pushed together through a definite distance. Moreover, the marginal portions of adjacent core frames have co-ordinated with them both a rigid marginal lining element corresponding to FIGS. 10 and 11, the marginal lining elements concomitantly being suspended displaceably on the corresponding marginal portions of the core frames. When the toggle lever systems 51, 70 are actuated, the lateral edge surfaces of the rigid lining elements are consequently thrust against the adjacent lining elements of a core frame and push these together by the distance made available by the draw wedge extracted.

It is possible moreover to arrange the draw wedge varying the width of the lining elements on sloping planes, so that the draw wedges are pushed out of the lining elements in vertical direction during horizontal displacement of the core frames $50_1$ to $50_4$.

Figure 6:
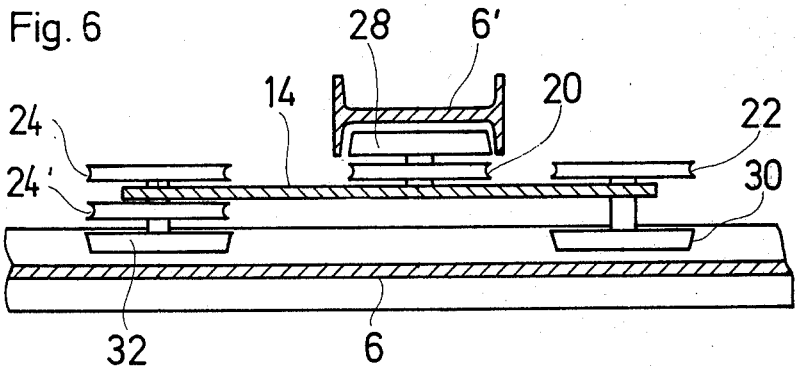
FIG. 6 shows a cross-section along the line II—II of FIG. 5.

Manifold modifications of the form of embodiment described are possible in respect of the number of form frames, of core frames and of the structures at either side of the same, as well as in respect of the cable guiding systems shown in FIGS. 4, 5 and 6, so that the form of embodiment should be considered as having been given by way of example only.

We claim:

1. A device for forming a structure useful as a mold comprising means defining a core (1), a plurality of intersecting frame members (2) arranged around the core defining a polyhedral enclosure, said frame members being individually movable toward and away from the core, at least one pulley (36,38) arranged near each end of the frame members, means guiding (8,12) said frame members toward and away from said core, support means (14) slidably engaging adjacent frame members at each intersection, a first set of pulleys (24,26) comprising at least two mounted on said support means (14), a second set of pulleys (20,22) mounted on said support means, at least one cable, a first portion (42) being reeved through the first set of pulleys and the pulleys mounted to the frame members in a block and tackle fashion such that shortening of said first portion moves at least one frame member away from said core, and a second portion (40) of said at least one cable being reeved through said second set of pulleys such that shortening of said second portion moves at least one frame member toward the core, and lining means for mounting on said frame.

2. A device according to claim 1 wherein said support means are cruciform and extend in the longitudinal directions of the frame members with which they are slidably engaged.

3. A device according to claim 2 wherein said first set of movable pulleys comprises two double pulleys positioned in spaced relationship and independently rotatable on said support means and said second set of pulleys comprises at least one single pulley.

4. A device according to claim 1 wherein said first and second cable portions (40,42) are separate cables.

5. A device according to claim 1 wherein said core means comprises a plurality of core frames mounted for displacement each acting as a carrier for a lining means.

6. A device according to claim 5 wherein opposing core frames are interconnected by means for reducing the spacing therebetween.

7. A device according to claim 6 wherein said means for reducing the spacing between core frames is a toggle lever which is mechanically actuated.

8. A device according to claim 7 wherein at least one of the lining means mounted on said core frame comprises means for reducing the width thereof.

9. A device according to claim 8 wherein the marginal gap between adjacent core frames is overbridged by a rigid marginal lining member supported by both core frames.

* * * * *